US005666754A

United States Patent [19]

de Oliveira Masina

[11] Patent Number: 5,666,754

[45] Date of Patent: Sep. 16, 1997

[54] LOCKING SYSTEM FOR INTEGRATED HAMMER OF SEMI-AUTOMATIC PISTOL

[75] Inventor: Ezio Renato de Oliveira Masina, Porto Alegre, Brazil

[73] Assignee: Forjas Taurus S/A, Porto Alegre, Brazil

[21] Appl. No.: 499,542

[22] Filed: Jul. 7, 1995

[30] Foreign Application Priority Data

Jul. 8, 1994 [BR] Brazil ..... 9402252

[51] Int. Cl.[6] ..... F41A 17/24

[52] U.S. Cl. ..... 42/70.08; 42/69.03

[58] Field of Search ..... 42/70.08, 69.03, 42/69.02

[56] References Cited

U.S. PATENT DOCUMENTS

| | | | |
|---|---|---|---|
| 771,806 | 10/1904 | Brown | 42/69.02 |
| 1,313,912 | 8/1919 | Reising | 42/69.02 |
| 2,584,299 | 2/1952 | SeFried III | 42/69.02 |
| 4,891,898 | 1/1990 | Houseman | 42/69.02 |
| 5,157,209 | 10/1992 | Dunn | 42/70.08 |

FOREIGN PATENT DOCUMENTS

| | | | |
|---|---|---|---|
| 321920 | 6/1920 | Germany | 42/69.02 |
| 552560 | 4/1943 | United Kingdom | 42/69.02 |
| 892960 | 4/1962 | United Kingdom | 42/69.02 |

*Primary Examiner*—Stephen M. Johnson

*Attorney, Agent, or Firm*—Cowan, Liebowitz & Latman, P.C.; Morey B. Wildes, Esq.

[57] ABSTRACT

A locking system for a pistol firing pin integrated within the firing mechanism of a semiautomatic pistol is composed fundamentally of a single part, called a tilting lock (1). The tilting lock (1) is duly housed in a slot (9) located in the lower part of bolt (10) and rotates about a shaft (8) fixed to the bolt itself (10). The lock (1) engages a notch (12) in firing pin (11) by the action of a spring (17) inserted in the slot (9) of bolt (10) and is disabled only at the instant of firing by the action of the projection (16) formed in the shoulder (15) of the arm (14) of the pistol's trigger (13).

6 Claims, 6 Drawing Sheets

FIG. 6
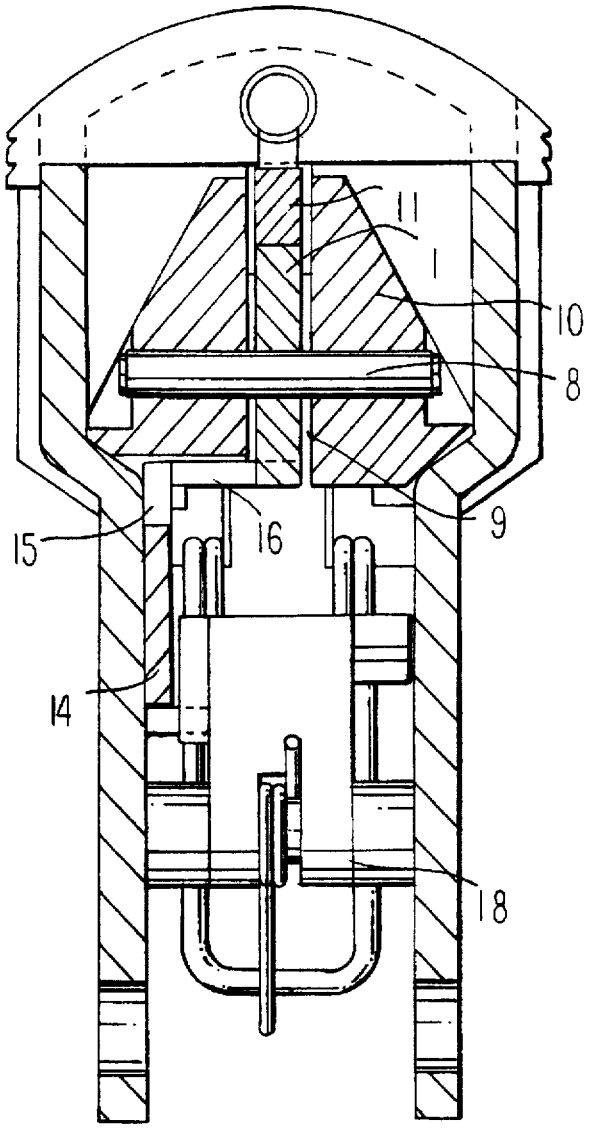
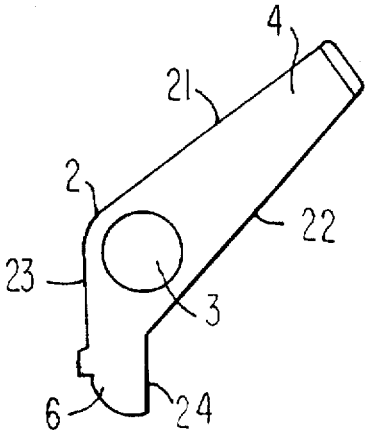
FIG. 7

LOCKING SYSTEM FOR INTEGRATED HAMMER OF SEMI-AUTOMATIC PISTOL

BACKGROUND OF THE INVENTION

The present invention refers to the locking system for a pistol firing pin and, more particularly, to a locking system for a pistol firing pin intimately integrated to the firing mechanism of a semi-automatic pistol.

The present invention was elaborated based on the pistol which is the central object of the Brazilian Patent No. PI 8805801, granted on May 25, 1993 to the present applicant.

More specifically, the invention herein described includes a system in which the firing pin lock is disabled only at the instant immediately preceding release of the firing pin by the catch, both operations being carried out by the movement of the trigger arm.

In the present state of art, there are several references to firing pin locking systems that were developed to make percussion impossible and to thus hinder firing of the pistol, except by the conscious and deliberate act of pressing the trigger.

Such systems exist so that pistols, for example, the Colt 1911, cannot fire accidentally as a result of enabling of the firing pin in case of dropping the pistol with barrel tip or hammer touching the ground, by the firing pin's own inertia, or by breakage of the catch and the consequent striking of hammer.

The firing pin locking systems presently used have in common the fact that they are the result of modifications of the standard firing mechanism by the addition of several parts, as occurs for example in the Beretta, Taurus and other pistols. In this way, in the above-mentioned systems, the movement of some components of the firing mechanism, such as the catch, the hammer and other parts, cause the action of more intermediate parts aiming at an action in the firing pin locking mechanism which commonly moves perpendicularly to the main axis of same mechanism.

Such type of movement has its mechanical efficiency impaired not only by the friction developed by the translation motion of the lock, but also and mainly for the interference of the inclined surfaces of the parts involved. This is the case of the Taurus pistol model PT-92. All this results in the above-mentioned locking systems negatively affecting the trigger touch by making it heavy and irregular, thus impairing firing precision either in target shooting or in defense shooting.

The reasons given above led to the development and the invention of the present firing pin locking system, which goes well beyond the pure application to the pistol object of said Brazilian Patent No. PI 8805801. It is, therefore, desirable to provide a firing pin locking system that is characterized by:

a) its intimate integration into the firing mechanism of the pistol, implying minimum modification of the original design;

b) the addition of practically one single part to the traditional firing mechanism;

c) movements such as the tilting of the lock which do not cause parasite translation friction, being only rotational movements of the lock, and have a maximum mechanical efficiency; and d) warranting the maximum safety of the lock without impairing the trigger touch.

SUMMARY OF THE INVENTION

In order to achieve the objectives described above, only the single small part indicated above, called a tilting lock, is added to the traditional firing mechanism. The tilting lock is duly housed in a slot located at the lower part of the bolt and rotates around a fixed shaft in the bolt itself.

The lock in question remains in locking position of the firing pin through the action of a small helical spring and will be disabled only at the instant preceding firing by the interference of an internal projection of the trigger arm tongue on said part.

BRIEF DESCRIPTION OF THE DRAWINGS

The present invention is not limited to the pistol described in Brazilian Patent No. PI 8605801, and the description that follows will not mention the components of the pistol that are not directly involved in the locking, since such components are finely detailed in the text itself of the above-mentioned patent. However, the above and other objects of the present invention will be better understood in reference to the attached drawings, in which the reference characters refer to like parts throughout and in which:

FIG. 6 is a cross-sectional view through line A—A of FIG. 1 passing by the firing pin lock axis; and FIG. 7 is an elevational view of lock (1) of FIGS. 1–6, shown here in isolation.

DETAILED DESCRIPTION OF THE INVENTION

Figure 1:
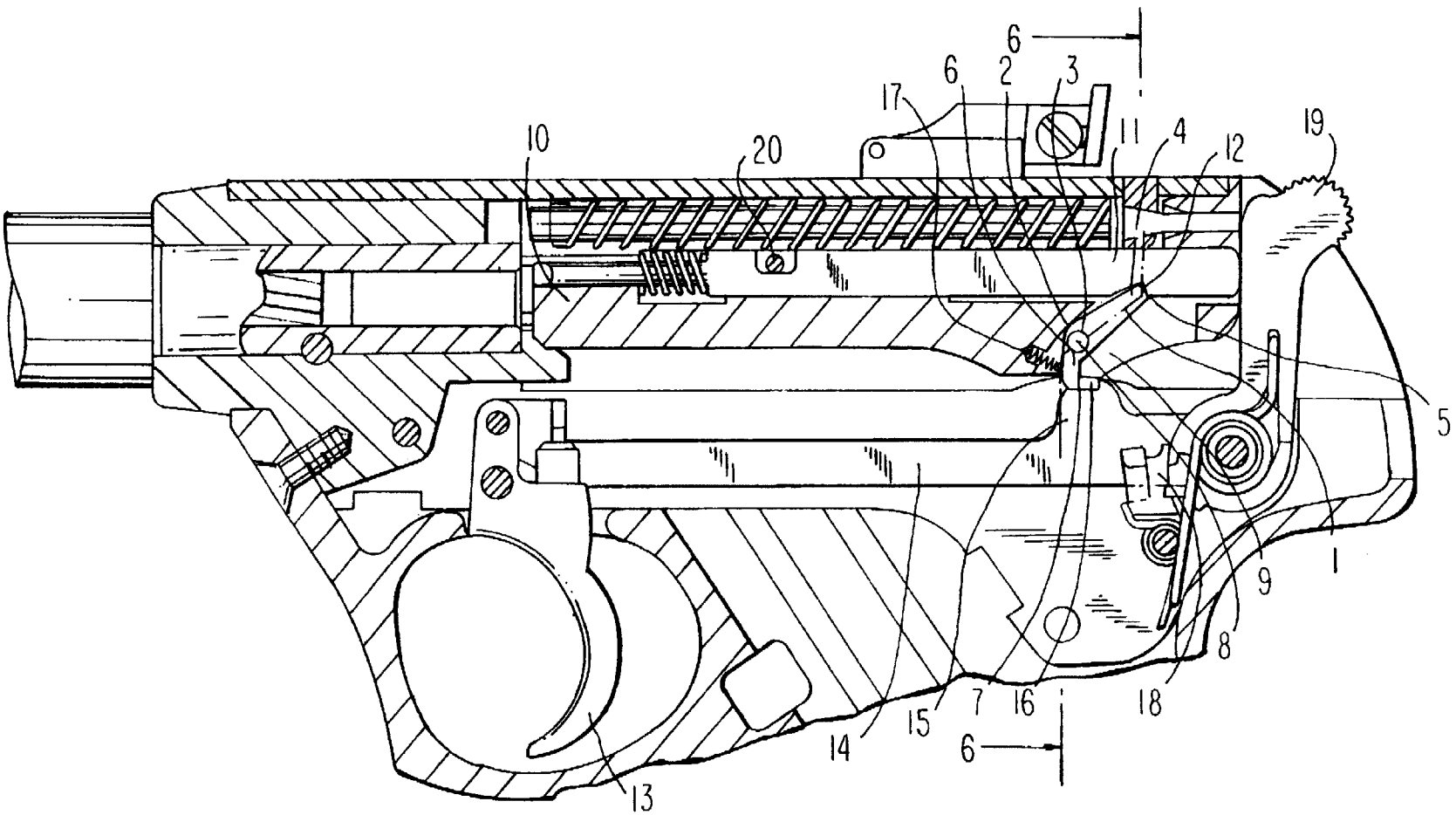
FIG. 1 is a cross-sectional view of the left side of a pistol with schematic representation of the firing mechanism and the percussion lock components, to the configuration taken when the trigger is in the rest position and after returning completely forward by the action of the corresponding spring, obliging the trigger arm to a maximum set back and where the hammer is represented in the manually lowered position.

As can be noted in the above mentioned FIGS. 1–6, lock (1) of firing pin (11) is constituted by a small steel plate whose width is practically equal to that used in the firing pin itself (see FIG. 6). As shown more clearly in FIG. 7, the contour of lock (1) is fundamentally composed first of an arc of a circle (2) concentric with hole (3) that is intended for the passage of lock shaft (8). The contour of lock (1) is also composed of a first straight line (21) tangent to this arc of circle (2) forming one side and a second straight line (23) tangent to the opposite face in relation of above-said hole (3) forming a second side, forming thus two slightly convergent straight lines, which define the upper contours respectively of an upper, larger arm (4) of lock (1) and of a lower, smaller arm (6) of lock (1). The contour of lock (1) is further comprised of a third straight line (22) slightly convergent with the first straight line (21) and of a fourth straight line (24) roughly parallel to the second straight line (23), which define the lower contours respectively of the upper, larger arm (4) and the lower, smaller arm (6) of lock (1).

The upper, larger arm (4) of lock (1) presents a small end (5) that engages a corresponding notch (12) positioned below the firing pin (11).

The lower, smaller arm (6) of lock (1) is intended to be actuated by the internal projection (16) of shoulder (15) of trigger (13) and is curved downwards in relation to the longitudinal symmetrical axis of larger arm (4). The front of lower arm (6) is as said above tangent to the arc circle and continues downwards in a sharper bend, ending in a sharp corner (7) at the intersection with the extension of the rear contour of arm (6).

This lock contour, as described above, can be considered as the generatrix of a cylindrical surface which straight-line generatrix has a length exactly equal to the thickness of the plate.

As can be seen in FIGS. 1, 2, 3 and 6, this small plate which constitutes the lock (1) is housed in a slot (9) cut in the lower face of bolt (10) and is attached to it, with freedom to turn, by shaft (8).

Additionally, on the inclined bottom wall (25) of slot (9) in bolt (10) is provided a hole intended to house the small helical return spring (17) lock (1) of firing pin (11).

Spring (17) acts on the front face of lower arm (6) of lock (1) forcing it to turn in an counterclockwise direction in figures up to the limit position established by bottom wall of slot (9) of bolt (10). This ensures that the end (5) of lock (1) on rising engages in the notch (12) of firing pin (11), thereby blocking forward motion of lock (1) and thus any accidental percussion. The lock geometry makes its action absolutely safe since the actuation line of force that the firing pin (11) may eventually and accidentally exert on arm (4) of lock (1) will be above the rotation axis (8) of lock (1) and would thus force the lock to turn in the direction of implementing the locking action.

On the other hand, the end (5) of lock (1) does not lean on the front surface of the notch (12) of firing pin (11) when firing pin (11) is pushed backwards to its projected surface which allows it to be struck by hammer (19). This ensures that the phase of lowering the end of larger arm (4) of lock (1) will be free of any friction with firing pin (11) and will not impair the "trigger touch".

Figure 2:
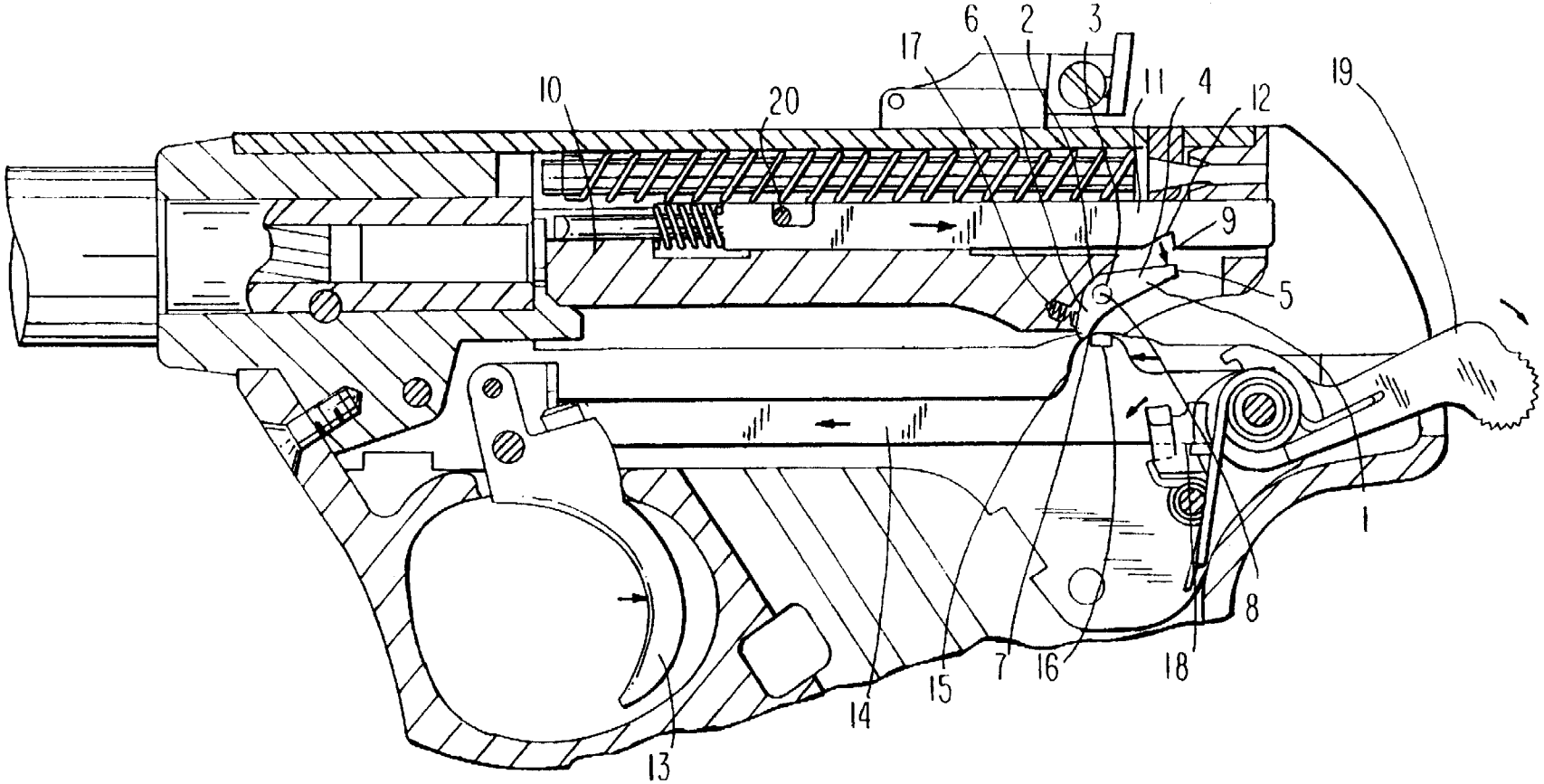
FIG. 2 is a view similar to FIG. 1, however in the configuration taken when the trigger is pressed up to the position in which the respective arm, by moving forward, actuates the catch, which is in the position that precedes the moment of release of the pistol firing pin.
Figure 3:
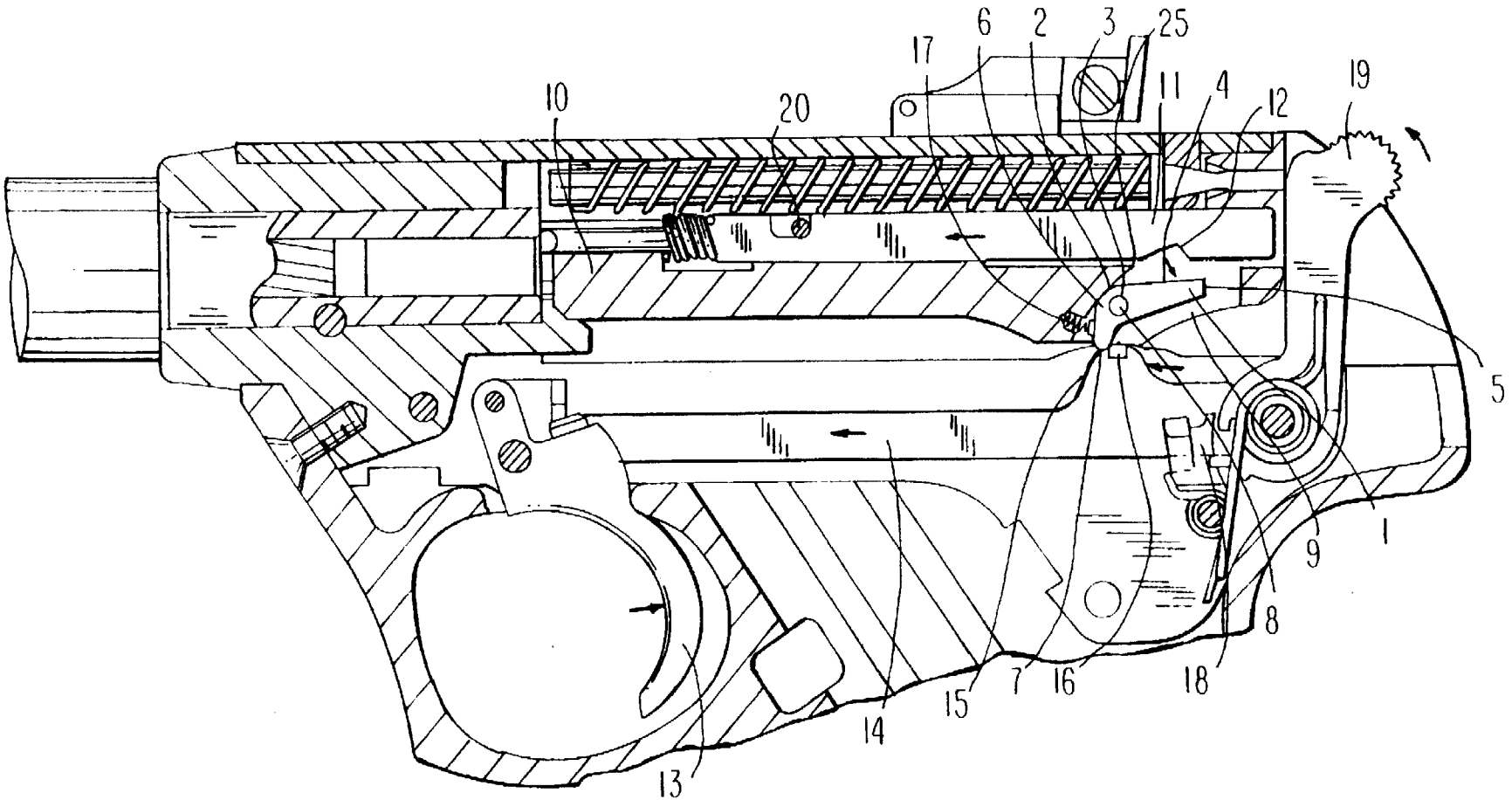
FIG. 3 is a view similar to the previous ones showing the moment in which the hammer released hits the hammer causing firing and the trigger, on continuing to be pressed, reaches its rearward position causing the maximum forward movement of the respective trigger arm.

As can be seen in FIG. 2, when trigger (13) is pressed, the respective trigger arm (14) moves forward and, before pulling the catch (18), pushes the vertical face of end of lower arm (6) of lock (1) through the projection (16) of shoulder (15). By the geometry of the lock, a small movement of the larger arm (4) is sufficient to cause a rotation in the clockwise direction and to thus lower the end (5) of larger arm (4) of lock (1) enough to release completely the firing pin (11) before the action of the hammer (19).

Figure 4:
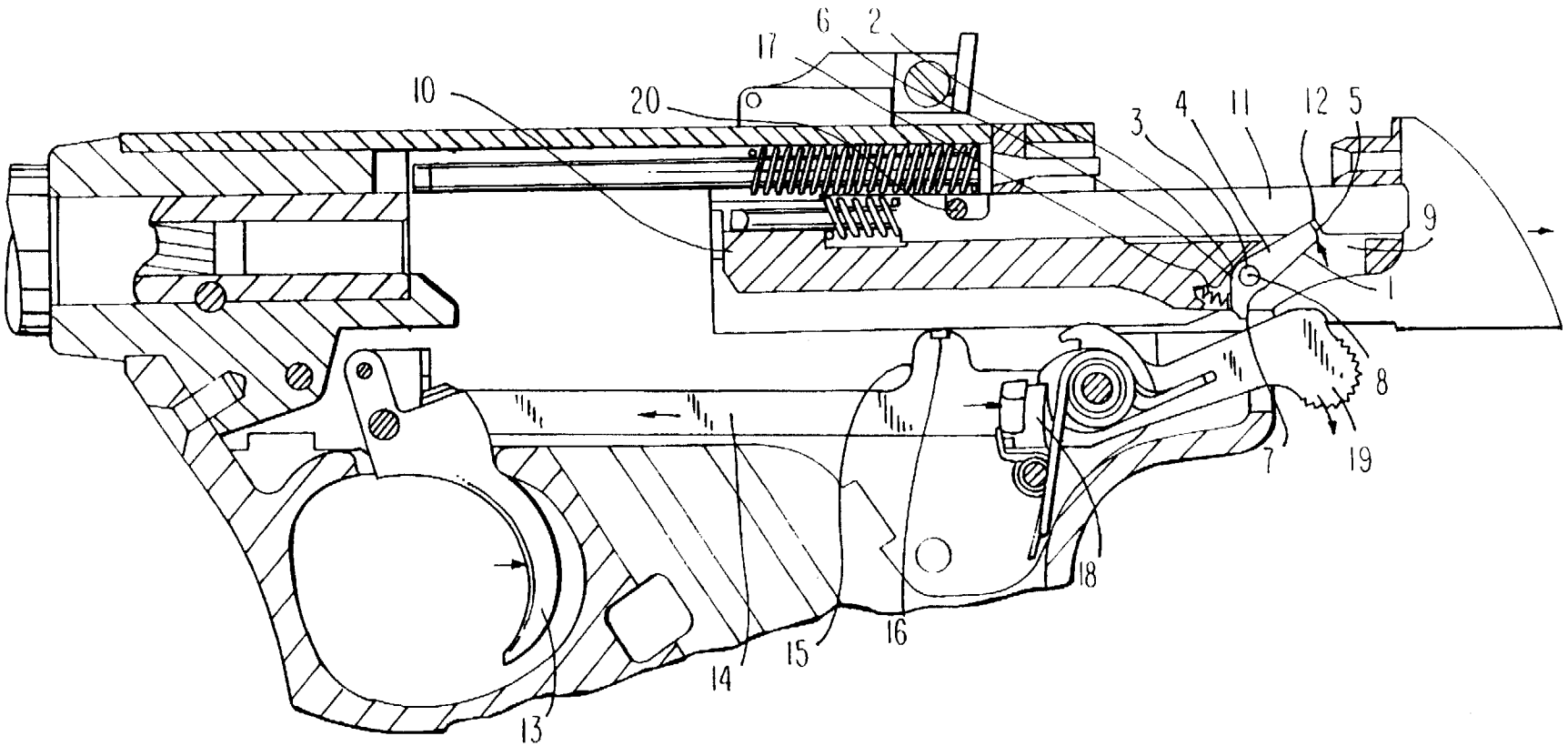
FIG. 4 is a view similar to that in the previous figures showing the moment of maximum rearward movement of the bolt after firing, with the trigger remaining pressed.

After firing, it can be seen in FIG. 4 that the bolt on moving rearwards acts on the projection (16) of arm (14) of trigger (13) by lowering it to the disconnection position in relation to the catch (18) and releasing the internal projection (16) of said shoulder (15) from any interference with the lock (1) of firing pin (11).

Figure 5:
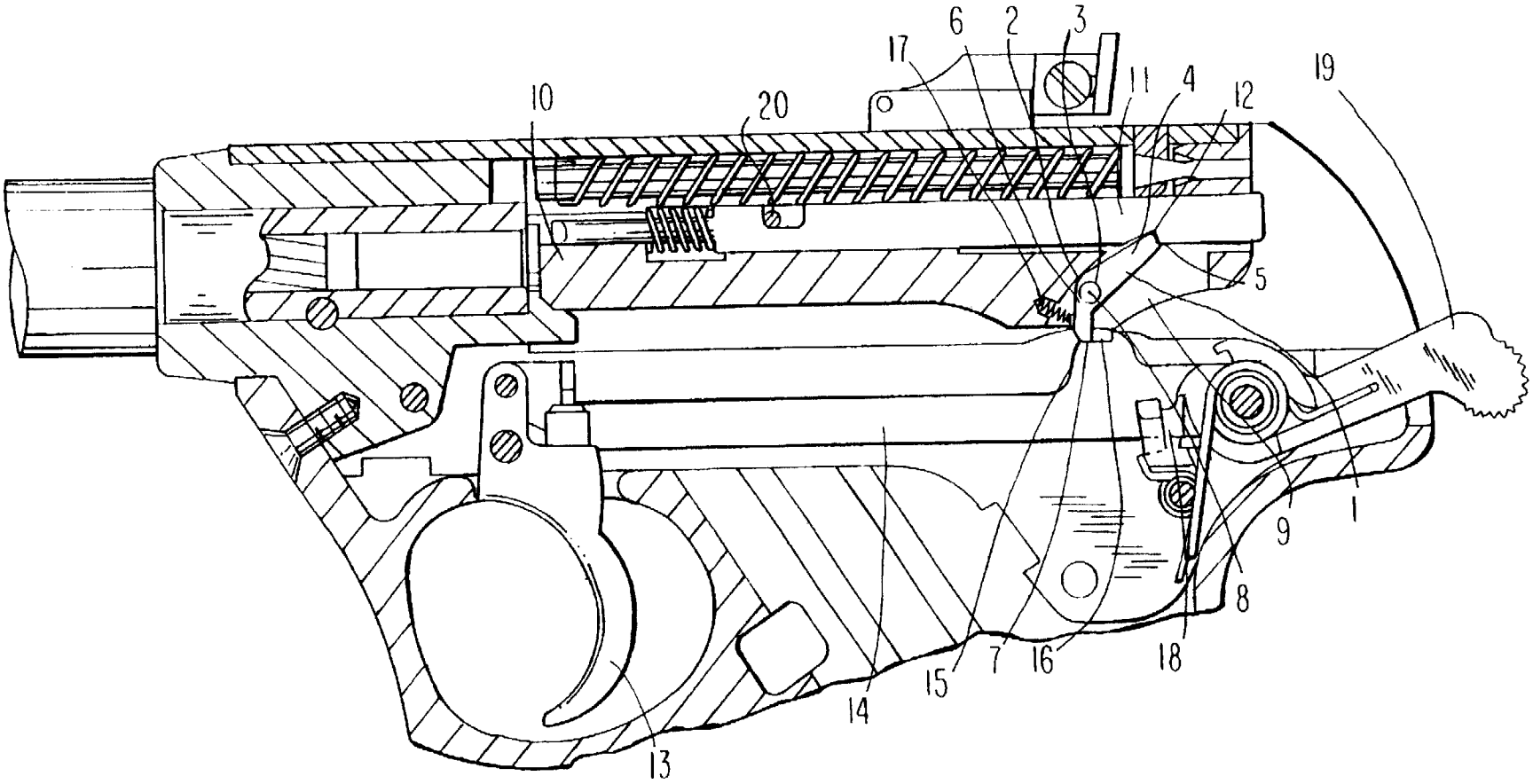
FIG. 5 is a view similar to the previous ones showing the next step in which the bolt is closed, the hammer is enabled and ready for the following firing, and the trigger is forward in the rest position.

On return of the bolt to the forward position, as illustrated in FIG. 5, there is no interference of the lock (1) with a projection (16) of shoulder (15) of arm (14) of trigger (13) since said arm (14) is lowered until the bolt reaches its completely closed position indicated in FIG. 5.

Additionally, the curvature of front face of lower smaller arm (6) of lock (1) avoids any interference or even undesirable lock with the projection (16) of shoulder (15) of arm (14) of trigger.

For a perfect relationship of the present invention with the pistol of said Brazilian Patent No. PI 8805801, some minor modifications are required in the original parts involved with the present system in order to adapt them to the incorporation of the firing pin lock (1) of the present invention. However, these modifications are limited to the shape of firing pin (11) and thus also in the shape of its housing in the bolt, to the position of the anchoring pin (20) and to the stroke limiter of said firing pin.

One skilled in the art will appreciate that the present invention can be practiced by other than the described embodiments, which are presented for purposes of illustration and not limitation, and the present invention is limited only by the claims that follow.

I claim:

1. A locking system for a firing pin integrated into the firing mechanism of a semi-automatic pistol having a firing pin (11), a bolt (10), a trigger (13) and a trigger arm (14), said locking system comprising a lock (1) rotatably mounted in a slot (9) in a lower part of said bolt (10) about a shaft (8) that is perpendicular to a longitudinal axis of said pistol such that said lock (1) can turn freely about said shaft (8), said lock (1) having an upper contour formed by an arc of a circle (2) concentric with a hole (3) intended for passage of said shaft (8) therethrough, formed by a first straight line (21) tangent to said arc of the circle (2) on one end of said arc, and formed by a second straight line (23) tangent to said arc of the circle (2) on the opposite end of said arc, thus forming two convergent straight lines, which define the upper contour of an upper larger arm (4) of said lock (1) and a lower smaller arm (6) of said lock (1), respectively.

2. The locking system in accordance with claim 1, wherein said bolt (10) has an inclined wall (25) at a bottom region of said slot (9), said wall comprising a hole in which is housed a helical return spring (17) for said lock (1) and which acts on said lower arm (6) of said lock (1).

3. The locking system in accordance with claim 1, wherein said firing pin (11) has a lower notch (12) by which a distal end (5) of said upper arm (4) of said lock (1) is engaged.

4. The locking system in accordance with claim 1, wherein said arm (14) of said trigger (13) has a projection (16) in a shoulder (15) which actuates said lock (1) through a sharp corner (7) at a distal end of said lower arm (6) of said lock (1).

5. The locking system in accordance with claim 1, further comprising a third straight line (22) slightly convergent with said first straight line (21) and opposite said hole (3) from said first straight line (21), defining the lower contour of said upper larger arm (4) of said lock (1).

6. The locking system in accordance with claim 5, further comprising a fourth straight line (24) parallel to said second straight line (23) and defining the lower contour of said lower smaller arm (6) of said lock (1).

* * * * *